US009144804B2

(12) United States Patent
Kessler et al.

(10) Patent No.: US 9,144,804 B2
(45) Date of Patent: Sep. 29, 2015

(54) COMMINUTING DEVICE COMPRISING A COMMINUTING ROTOR HAVING A CONTINUOUS KNIFE

(71) Applicant: Vecoplan AG, Bad Marienberg (DE)

(72) Inventors: Heiko Kessler, Hof (DE); Pierre Wiezorek, Kirburg (DE)

(73) Assignee: Vecoplan AG, Bad Marienberg (DE)

( * ) Notice: Subject to any disclaimer, the term of this patent is extended or adjusted under 35 U.S.C. 154(b) by 150 days.

(21) Appl. No.: 13/926,667

(22) Filed: Jun. 25, 2013

(65) Prior Publication Data

US 2014/0001297 A1 Jan. 2, 2014

(30) Foreign Application Priority Data

Jun. 28, 2012 (DE) ..... 10 2012 211 186

(51) Int. Cl.
*B02C 18/18* (2006.01)
*B02C 18/14* (2006.01)

(52) U.S. Cl.
CPC ..... *B02C 18/18* (2013.01); *B02C 18/14* (2013.01); *B02C 18/145* (2013.01); *B02C 2018/188* (2013.01)

(58) Field of Classification Search
CPC .. B02C 18/145; B02C 18/18; B02C 2018/188
USPC ..... 241/243, 294, 293, 73
See application file for complete search history.

(56) References Cited

U.S. PATENT DOCUMENTS 5,165,611 A 11/1992 Ragnarsson
7,213,778 B2 * 5/2007 Astafan et al. ..... 241/73
7,832,667 B2 * 11/2010 Doppstadt et al. ..... 241/73
7,900,859 B2 * 3/2011 Carpenter ..... 241/243
8,434,705 B2 5/2013 Lipowski (Continued)

FOREIGN PATENT DOCUMENTS

AT 006 937 UI 6/2004
DE 691 26 539 T2 12/1997

(Continued)

OTHER PUBLICATIONS

Search Report for European Application No. 13 17 1025 dated Dec. 1, 2014.
German Office Action for Application No. 10 2012 211 189.7, dated Apr. 4, 2012.

*Primary Examiner* — Faye Francis
(74) *Attorney, Agent, or Firm* — Alston & Bird LLP

(57) ABSTRACT

A comminuting device for waste products and/or production waste is described that includes a driving device that drives at least one comminuting rotor presenting on the periphery thereof a number of comminuting tools that are fixed to the comminuting rotor, for forming at least one knife bank extending in the axial direction with one directional component The comminuting tools cooperates with at least one counterknife arrangement adapted in its form to the rotation surface of the comminuting rotor equipped with said tools, for disintegrating the material to be processed. Neighboring comminuting tools within a knife bank are arranged adjacent to each other at respectively associated lateral faces and offset to each other on the periphery of the rotor, such that equivalent cutting edges of neighboring comminuting tools have the same distance to the rotor axis and each lie in a plane that runs parallel to the rotor axis.

14 Claims, 12 Drawing Sheets

(56) References Cited

U.S. PATENT DOCUMENTS

| | | | | |
|---|---|---|---|---|
| 2003/0075628 | A1* | 4/2003 | Pretzler et al. | 241/243 |
| 2010/0181405 | A1* | 7/2010 | Bouwhuis et al. | 241/236 |
| 2011/0147504 | A1* | 6/2011 | Lipowski | 241/30 |

FOREIGN PATENT DOCUMENTS

| | | | |
|---|---|---|---|
| DE | 20 2005 000 675 | U1 | 6/2005 |
| DE | 10 2009 060523 | A1 | 6/2011 |
| WO | WO 92/11942 | A1 | 7/1992 |

* cited by examiner

COMMINUTING DEVICE COMPRISING A COMMINUTING ROTOR HAVING A CONTINUOUS KNIFE

BACKGROUND OF THE INVENTION

The invention relates to a comminuting device for material to be comminuted such as waste products and/or production waste, the device comprising a drive equipment that drives at least one comminuting rotor, which includes on its periphery a number of comminuting tools that are fixed to the comminuting rotor, for forming at least one knife bank that extends in the axial direction with one directional component, wherein said comminuting tools cooperate with at least one counterknife arrangement having a form which is adapted to the rotary surface of the comminuting rotor equipped with said tools, for disintegrating the material to be processed.

Such comminuting devices are used for example for disintegrating wood, paper, plastic material, rubber, textiles, production waste or waste material from industry and trade, but also bulky material, domestic waste, paper and DSD collections (DSD=German Green Dot System) such as hospital waste etc. The material to be comminuted is disintegrated by cutting, shearing, crushing, ripping and/or grinding under cooperation of comminuting tools fixed to the rotor with an associated counterknife arrangement. A device of this kind is described for example in the German patent application publication DE 10 2009 060 523 A1. Designing the knife bank in such a manner that the same extends somewhat slantingly to the axis, can facilitate especially the comminution of thin components within the material to be comminuted such as films or textiles, by providing for a scissors-like cutting operation.

It is an object of the invention to improve the throughput of the described conventional comminuting device and to simplify maintenance thereof.

SUMMARY OF THE DISCLOSURE

Surprisingly, the present invention solves this object, at least partially, alone by a comminuting device that is characterized in that neighboring comminuting tools in a knife bank are arranged adjacent to each other and abutting on each other, particularly at associated lateral faces, and are offset to each other on the periphery of the rotor, wherein equivalent cutting edges of neighboring comminuting tools have the same distance to the rotor axis and each lie in a plane that runs parallel to the rotor axis. By the fact that other than in prior art in which the comminuting tools are slantingly fixed to the rotor and thus with different distances to the rotor axis regarding their knife edge or regarding their knife edge plane, the comminuting tools are fixed in such a manner that equivalent cutting edges of the comminuting tools each have the same distance to the rotor axis, flight circles of the individual comminuting tools are obtained which are in fact identical and can thus cooperate in the same manner with a counterknife arrangement that is likewise symmetrically designed, for optimum comminution of the material to be comminuted. The inventive arrangement of the individual comminuting tools on the rotor provides for a very small and constant clearance between the cutting edges of the counterknife arrangement and the cutting edges of the knife bank on the comminuting rotor over the entire axial extension of the knife bank, which significantly increases the throughput of the comminuting device of the invention.

The comminuting tools forming a knife bank are arranged adjacent to each other, preferably abutting on each other, with two neighboring comminuting tools overlapping each other in the peripheral direction of the rotor, i.e. tangentially to the rotor, due to a predetermined extension of the tools in the peripheral direction of the rotor. Preferably, the extension of the tools in their installed position in the tangential direction is very much greater than this offset of neighboring comminuting tools in the peripheral direction of the rotor so that neighboring tools overlap each other in the said peripheral direction over a major part of their extension in the peripheral direction of the rotor.

The arrangement of comminuting tools on the rotor is preferably such that most expediently no gap is present between neighboring comminuting tools, in particular no gap between neighboring cutting edges of neighboring comminuting tools, taking into account manufacturing tolerances. Should a small gap occur between neighboring comminuting tools due to manufacturing tolerances, this gap is preferably much smaller than the extension of the tool in the direction of the respective knife bank so that the comminuting tools, which are arranged side by side and offset on the periphery of the rotor, substantially form a continuous blade. Here the usually small offset of neighboring comminuting tools to each other in the peripheral direction of the rotor is accepted with a view to providing identical flight circles for all said comminuting tools.

Further advantageous embodiments and features of the invention will become apparent from the following general and specific descriptions and from the appended claims.

The comminuting tools of the comminuting device of the invention can be designed in such a manner that in the installed position and as a part of a knife bank they each provide a single cutting edge in the configuration of a straight blade of the knife bank or also several cutting edges extending at a predetermined angle to each other if for example a saw-like blade of the knife bank is designed. In the latter case, it can be particularly provided that a single one of these comminuting tools is designed in such a manner that in its installed position it provides an individual saw tooth of a continuous blade on the comminuting rotor in such a manner that all cutting edges of the individual adjacent or abutting and peripherally offset cutting teeth constitute the said uninterrupted, substantially continuous saw tooth-like blade.

To afford flexible maintenance if wear occurs on the comminuting tools, it can be provided that a comminuting tool is detachably fixed to the rotor by means of an associated tool holder, wherein the respective tool holder can be arranged in a holder seat incorporated into the comminuting rotor. In this manner, a comminuting tool which is supported by the tool holder can be easily exchanged so that it is possible during maintenance to exchange or replace only those comminuting tools which are excessively worn or have for example been damaged by foreign material. Tools which are not worn can remain in the respective knife bank, for forming a single, continuous blade. According to the invention, such a holder seat can be in the form of a pocket and preferably said pocket can be open in the rotating direction of the rotor because almost no forces are transmitted in this direction.

Preferably, such a tool holder can have an angular and preferably a quadrangular base area, wherein a seat for receiving the associated comminuting tool is provided on a front side of the tool holder facing the rotating direction of the rotor.

For directing forces occurring during operation to the rotor, it can be provided that the holder seat provides a contact surface for the tool holder which is approximately tangential to the rotor and against which the tool holder is supported in the tangential direction.

For improving the support of the tool holder in the holder seat on the rotor or for pre-mounting the tool holder to the rotor, for example for a subsequent welding operation, it can be preferably provided that radially extending elements, particularly in the form of locating pins, are incorporated into the rotor, said locating pins extending out of the holder seat and into the associated tool holder.

The tool holder can be fixed to the rotor for example by welding or by means of a screw connection.

A detachable connection between the comminuting tool and the associated tool holder can be implemented in particular by the respective comminuting tool being fixed by means of a fixing bolt extending through the associated tool holder. The comminuting tool can have a thread, and the fixing bolt can be screwed into the thread. Preferably, the fixing bolt can extend through the tool holder approximately tangentially to the rotor axis and through the tool, at least partially.

To make sure that a tool holder is stably supported in its holder seat despite prevailing operating forces, it can be preferably provided that tool holders of neighboring comminuting tools of a knife bank abut on each other at associated side faces and thus stabilize each other approximately in an axial direction. The construction can be so that normally no gap exists between neighboring tool holders, taking into account given manufacturing tolerances, so that a given tool holder is clamped between and supported against neighboring tool holders in an approximately axial direction to the rotor or in the direction of the knife bank.

For providing a comminuting device in which the comminuting tools fixed to the rotor cooperate with an associated counterknife arrangement in the manner of a scissors-type cut on the one side and for avoiding on the other side that, during operation, the material to be comminuted is imposed a motion component in the axial direction to the rotor as a result of the slanted arrangement of the knife bank, it can be preferably provided that several knife banks which are each formed by a plurality of comminuting tools are attached to the rotor, two of these knife banks being respectively spaced on the periphery of the comminuting rotor and arranged in opposite directions to each other, for a mutual compensation of an axial motion component on the material to be comminuted.

For avoiding an increased friction of the material to be comminuted against the rotor in the region of the comminuting tools, it can be expedient if a continuous recess extending parallel to the knife bank is incorporated into the comminuting rotor upstream of a knife bank in the rotating direction, for forming a chip pocket. The term "continuous" means that this recess extends over the entire axial extension of the knife bank. The peripheral extension of this recess upstream of the comminuting tools preferably approximately corresponds to the extension of the installed comminuting tools in the radial direction to the rotor.

To provide for a multiple use of a comminuting tool, it can be provided that such a tool is designed as a reversible plate arranged in a prismatic seat of the associated tool holder. In particular, such a reversible plate can have a square base area so that depending on the orientation of this reversible plate in the tool holder a tool is provided which has a single blade, or a tool which represents a cutting tooth having at least two cutting edges.

BRIEF DESCRIPTION OF THE DRAWINGS

In the following, embodiments of the invention will be described with reference to the attached drawing figures, wherein it is shown by FIG. 1 an overall view of a comminuting device of the invention.

DETAILED DESCRIPTION OF THE DRAWINGS

Figure 1:
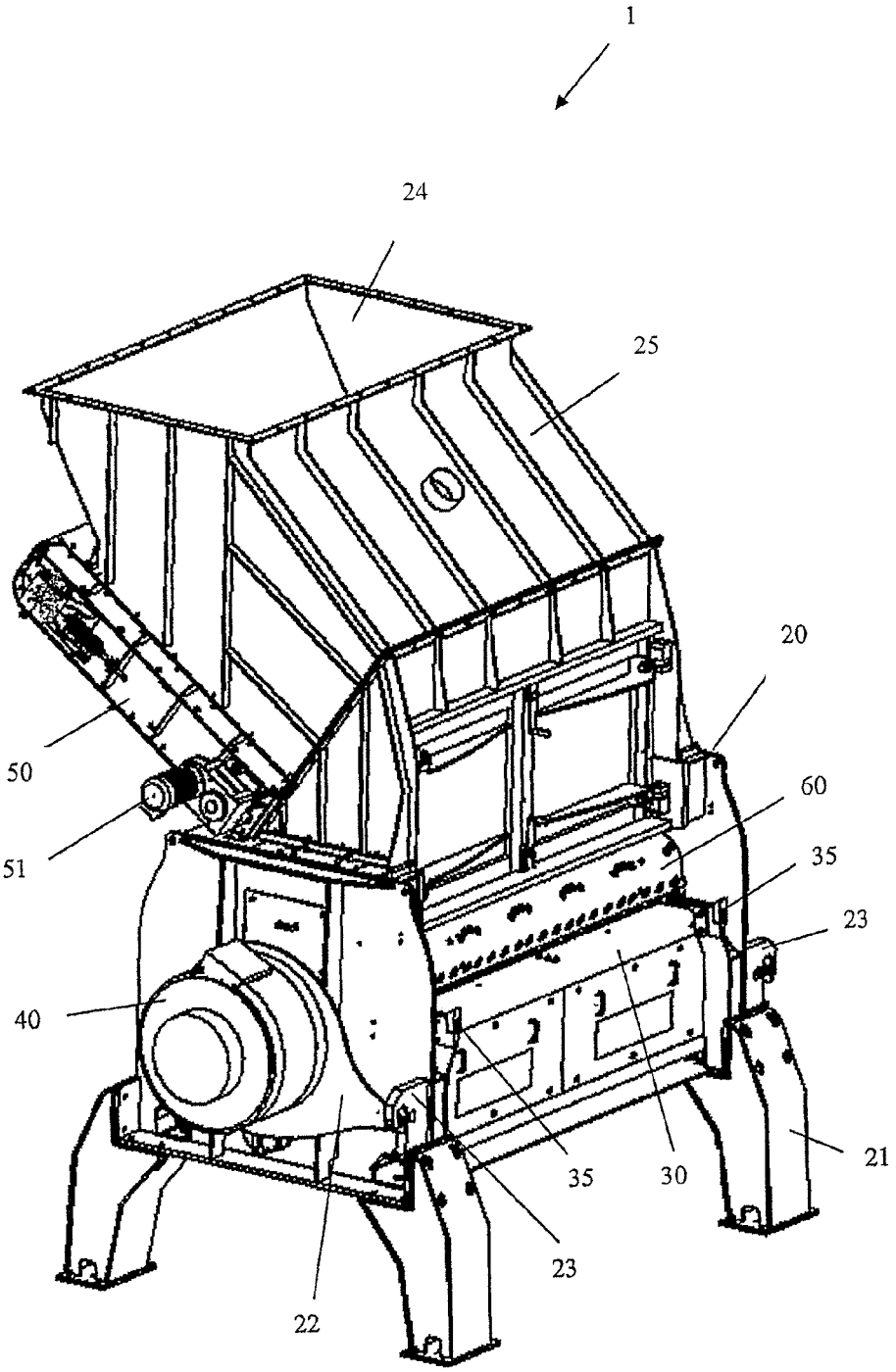

FIG. 1 shows a perspective view of a comminuting device 1 according to the invention. On the machine housing 20 a comminuting rotor is supported in the region of both longitudinal ends thereof, wherein in the described embodiment a three-phase AC motor 40 is flanged in a gearless manner to each of the two ends. The power unit is coupled to the machine housing 20 through a holder 23 and via a torque support 22 for receiving a reaction torque occurring during the operation of the device. In the illustration of FIG. 1, the second three-phase AC motor for driving the rotor is concealed, but the holder 23 can be seen through which also the second motor is coupled to the housing 20, again via a torque support for receiving the reaction torque.

The comminuting tools which are peripherally arranged on the rotor, cooperate with a counterknife arrangement installed in a stationary manner with respect to the housing during the comminuting process, for disintegrating the material to be comminuted, wherein in the described embodiment the counterknife arrangement is constructed as a traverse 60 carrying counterknives. In the Figure, the material to be comminuted is supplied to the opening 24 of a sheet metal funnel 25 from the top and then drops into the comminuting space defined by the comminuting rotor. For supporting the feeding of the material to be comminuted to the comminuting space, there is further provided a conveying device 50 in the form of a chain conveyor that is driven by a motor 51.

In the illustrated embodiment, the comminuting device 1 is supported on the ground by four legs 21. Between these legs a conveyor belt can be arranged for receiving and removing the comminuted material falling down.

Figure 2:
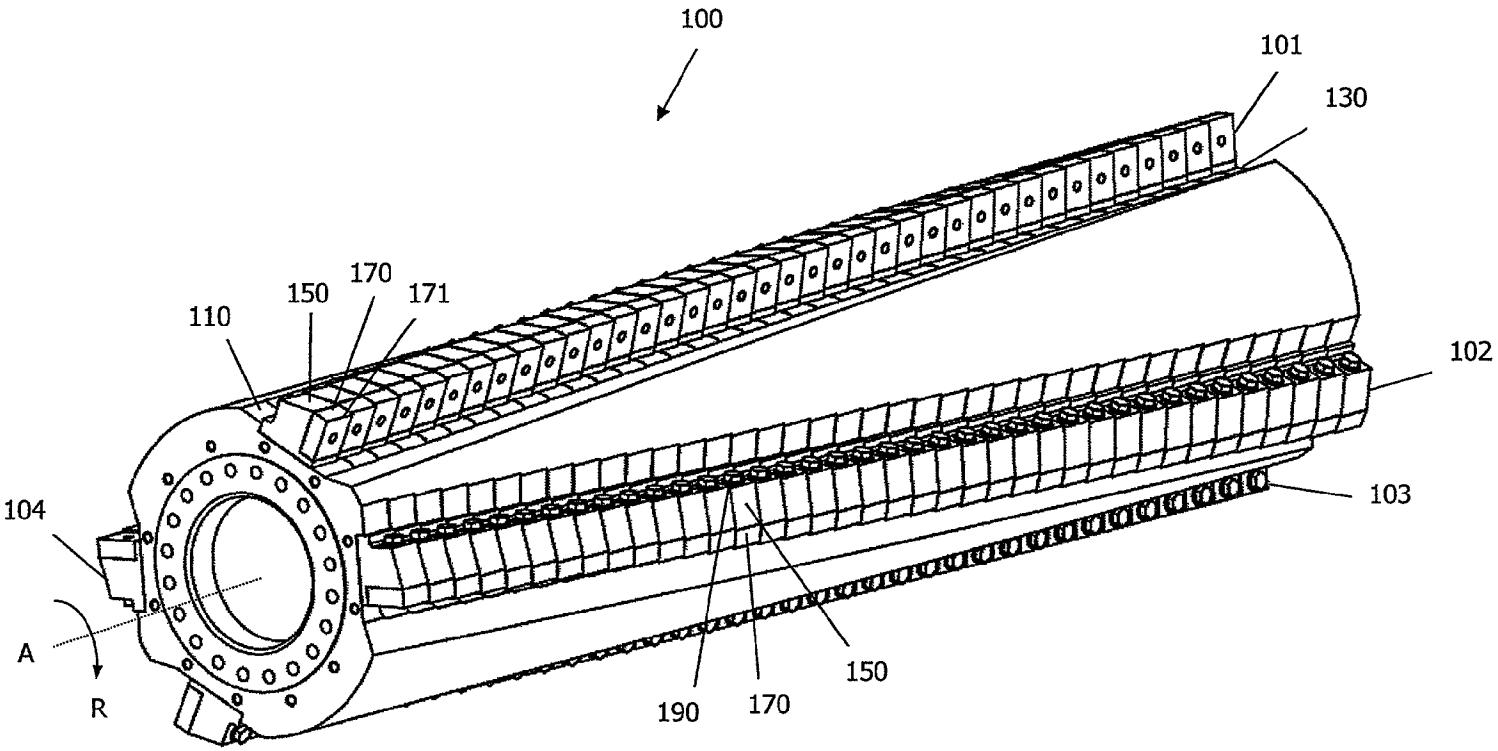
FIG. 2 a comminuting rotor constructed according to the invention and equipped with a plurality of smooth knives.

FIG. 2 shows a first embodiment of a comminuting rotor 100 constructed according to the invention and including four knife banks 101, 102, 103 and 104, which are each formed by a plurality of mutually adjacent comminuting tools in the form a quadrangular smooth-knife reversible plate 170, which is respectively fixed to the rotor 100 by means of an associated tool holder 150. Each knife bank 101-104 is oriented somewhat slantingly with respect to the rotor axis, in the present case under an angle of approx 20 degrees. Thus the material to be comminuted is imposed a motion component parallel to the rotor axis during the comminuting process. For compensation, two of these knife banks 101 to 104 are respectively oriented oppositely to each other.

As can be seen particularly from the illustration of the knife bank 102, the individual reversible plates 170 are each fixed to the associated tool holder 150 by means of a screw 190. By rotating the reversible plates by 180 degrees about their fixing axis, a second cutting edge is made accessible, while the worn cutting edge is supported on the tool holder.

In the described embodiment, all reversible plates 170 and the associated tool holders 150 are identically constructed. Each reversible plate 170 presents in the installed position thereof an exposed cutting edge 171 that cooperates with an associated edge on the counterknife, for comminuting the material. All cutting edges of the reversible plates 170 are respectively parallel to the rotor axis A. Reference sign R identifies the rotating direction of the rotor.

For its fixing to the comminuting rotor, each tool holder 150 includes a holder seat 110 incorporated into the comminuting rotor, each of said holder seats being peripherally incorporated into the rotor in a manner offset to each other. In the rotating direction of the tools and over the entire axial extension of the knife bank, a recess for providing a chip pocket 130 extending along and parallel to the knife bank is worked into the rotor, for collecting disintegrated material.

The arrangement of the tools on the rotor is such that the cutting edges 171 of the individual tools all have the same distance to the axis A of the rotor so that each tool will describe the same flight circle, which fact considerably facilitates the design of the counterknife arrangement and affords a particularly high throughput efficiency of the comminuting device of the invention. For this purpose, one holder seat 110 is incorporated into the rotor for each tool holder, wherein neighboring holder seats are peripherally incorporated into the rotor in an offset manner, while not only said neighboring tools but also neighboring tool holders overlap each other circumferentially. Depending on the embodiment, this circumferential offset of neighboring tool holders and thus of neighboring tools amounts to approx 0.25 degrees to 1.5 degrees, in the described embodiment approx 0.5 degrees.

The described arrangement of the comminuting tools results in the cutting edges of the comminuting tools of a knife bank forming a substantially continuous cutting edge. The knife bank extends slantingly relative to the axis A of the rotor, i.e. at an acute angle to a parallel to the axis A of the rotor.

Figure 3:
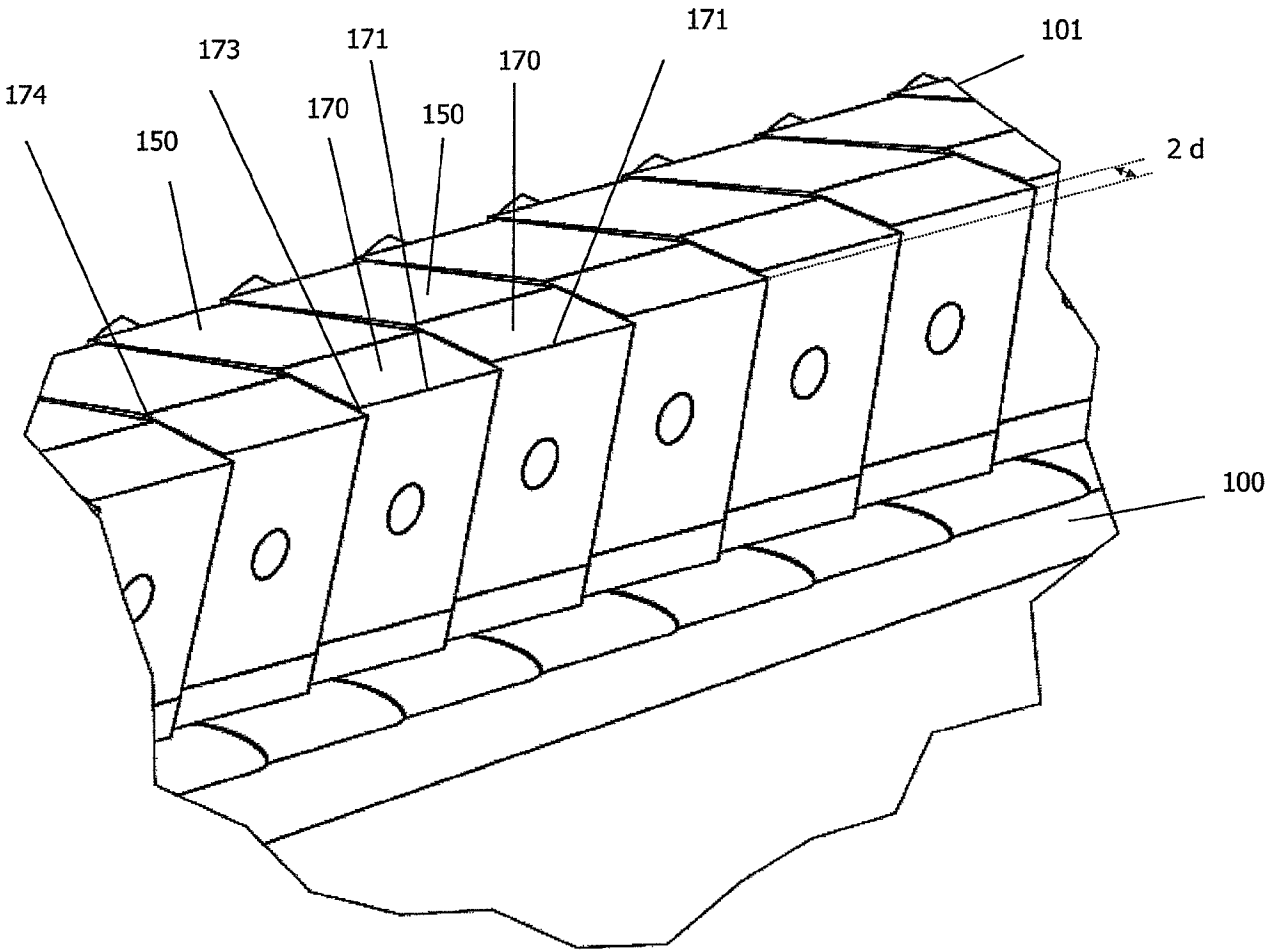
FIG. 3 a clipping of a detail of the comminuting rotor according to FIG. 2.

FIG. 3 shows a detail of the knife bank 101 of FIG. 2. It can be seen that neighboring reversible plates 170 adjoin each other laterally and touch each other and are supported against each other in the axial direction to the rotor, preferably over a major part of their associated side faces 173, 174. As the holders 150 and thus the reversible plates 170 are circumferentially offset to each other on the rotor, the respective cutting edges 171 are not aligned with each other. On the other hand, however, each of these cutting edges 171 extends parallel to the axis A of the rotor, see FIG. 2. The described offset between three reversible plates is indicated by 2*d* in the Figure, i.e. the offset between the plates is d.

Figure 4:
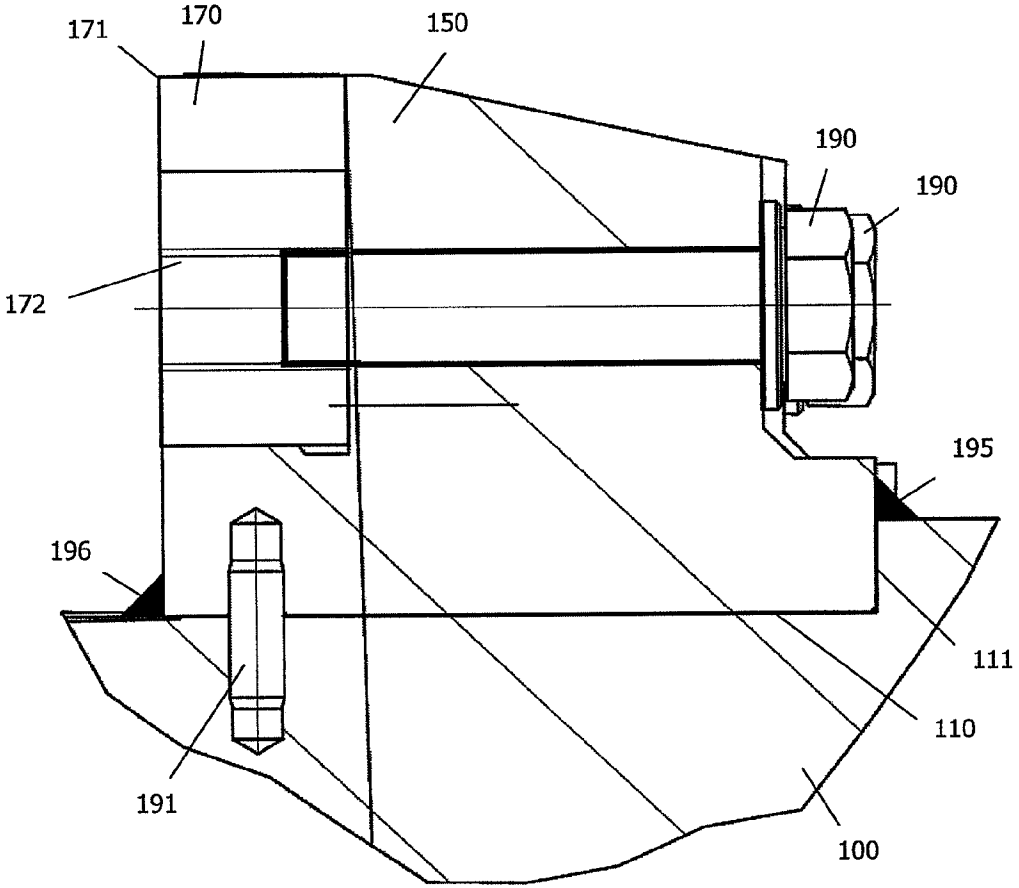
FIG. 4 a section through a tool holder supporting a smooth knife.

FIG. 4 shows a section through the detail illustrated in FIG. 3, wherein the section is made parallel to one of the fixing screws 190, thus revealing the fixing of the tool holder 150 to the rotor 100 and the fixing of the reversible plate 170 to the tool holder 150. In the described embodiment, the fixing screw 190 extends approximately tangentially to the rotor and thus approximately vertically to the cutting edge 171 of the respective smooth knife. The holder seat 110 incorporated into the rotor 100 provides a contact surface 111 in the rotating direction of the rotor, the normal of said contact surface being oriented approximately tangentially to the rotor and thus provides an abutment for the holder 150, for introducing comminuting forces into the rotor.

Two pins 191 extend approximately radially to the rotor and into the rotor and protrude out of the holder seat 110 and into associated bores in the respective holder 150, for improving the connection between the tool holder 150 and rotor 100 or for fixing the holder to the rotor, for foaming welding seams 195, 196 that extend over the entire knife banks 101 to 104 on the front and rear sides of the holders 150.

As can be seen, the smooth-knife reversible plate 170 has a centric threaded bore 172, and the bolt 190 is screwed into said bore. The holder 150 thus provides a seat that is adapted to the geometry of the smooth knife 170.

Figure 5:
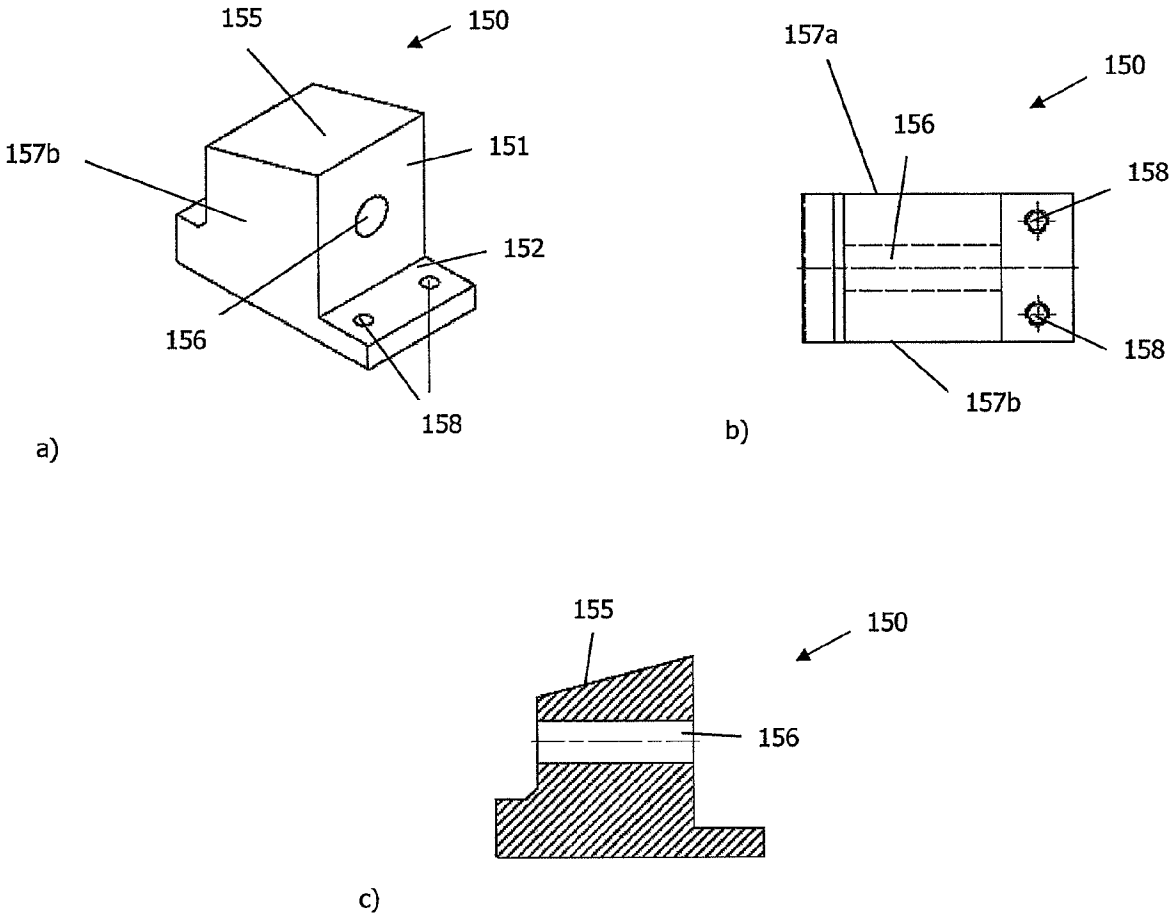
FIG. 5*a* a perspective view of a tool holder for a smooth knife.
FIG. 5*b* a top view of the tool holder according to FIG. 5*a;*
FIG. 5*c* a section through the tool holder according to FIG. 5*a;*

The FIGS. 5*a* to 5*c* show different detailed views of the tool holder 150. The seat or the receiving structure for the smooth knife 170 is provided by the contact surfaces 151, 152. In the described embodiment, the surface 151 is adapted to the main surface of the smooth-knife reversible plate 170 in such a manner that the edges of the knife are aligned with the limiting edges of the contact surface 151. In the same manner, the contact surface 152 is adapted to the dimensions of the smooth-knife reversible plate on the front side thereof. The bore 156 serves to receive the bolt 190 and the bores 158 serve to receive the pin 191, see FIG. 4. FIG. 5*c* shows a section of the tool holder centrally through the bore 156. From the seat of the tool on the tool holder 150 an inclined surface 155 is provided, for preventing the material to be comminuted from being jammed between the holder and the counterknife. As shown by the FIGS. 3 and 5*a, b*, neighboring tool holders 150 abut on each other at the associated lateral faces 157*a, b* and support each other in the axial direction to the rotor. The cutting edges 171 of all comminuting tools of the respective knife bank form a substantially uninterrupted, continuous cutting edge, wherein the offset between adjacent comminuting tools lead the knife bank to extend in a slanted manner with respect to the rotor axis A.

Figure 6:
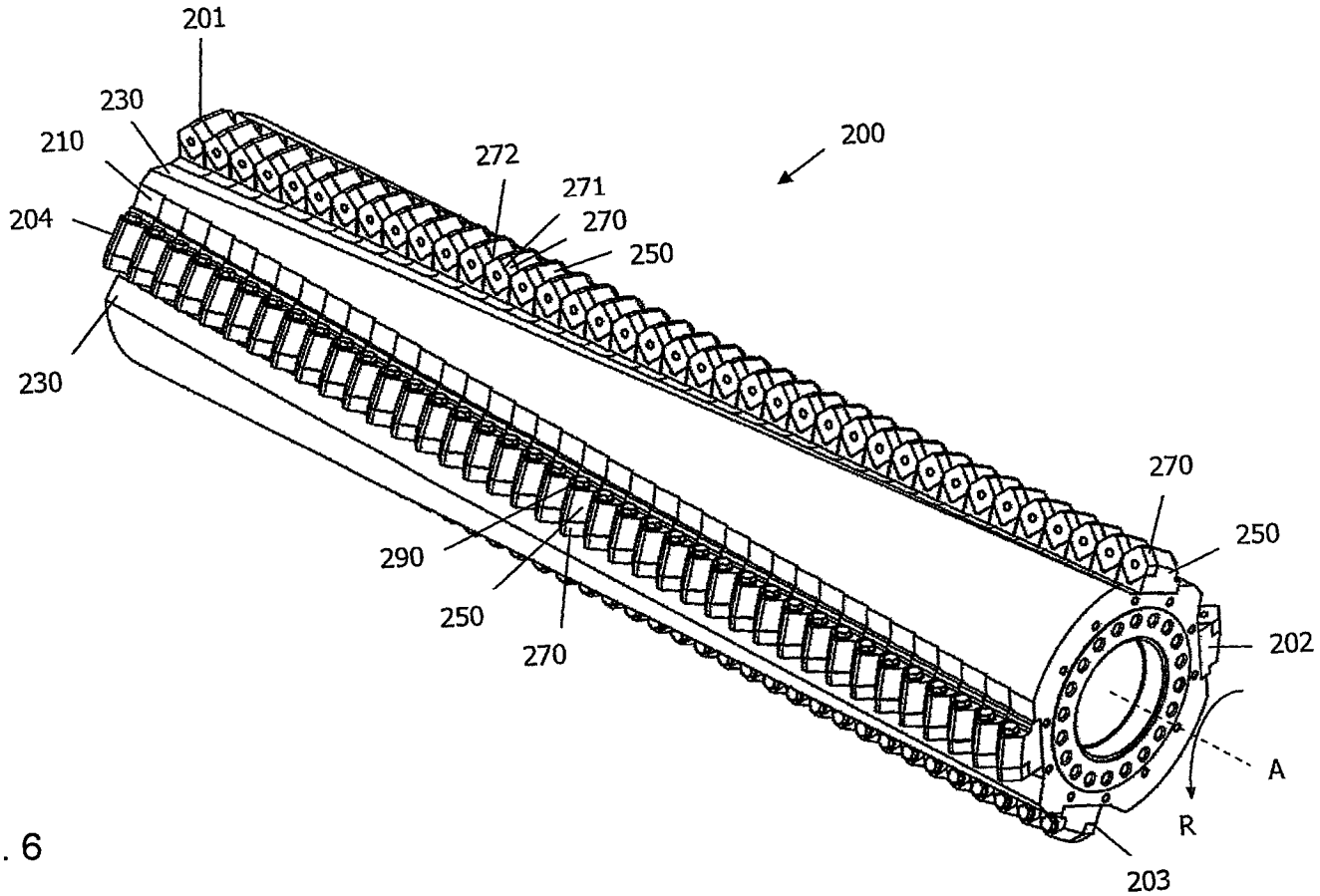
FIG. 6 a further embodiment of a comminuting rotor comprising a plurality of toothed cutting tools in the form of a single knife tooth.

FIG. 6 shows a second embodiment of a comminuting rotor 200 of the invention, which comprises several knife banks 201-204, each extending in a slanted manner with respect to the axis A of the rotor. Each of these knife banks again comprises a plurality of comminuting tools 270, which are arranged adjacent to each other and are offset to each other on the periphery of the rotor, wherein equivalent cutting edges 271, 272 of neighboring comminuting tools have the same distance to the rotor axis and each lie in plane that runs parallel to the rotor axis A. In the embodiment shown in FIG. 6 there is also provided a chip pocket 230 that is arranged upstream of the respective knife bank in the rotating direction and extends over the entire extension of the knife bank.

The essential difference to the comminuting rotor shown in FIG. 2 is that the comminuting tools are not designed as a smooth-knife reversible plate having a single cutting edge 171 in its installed position but instead comprise a reversible plate 270 which in its installed position presents an exposed knife tooth, wherein such a knife tooth includes two converging cutting edges 271, 272 that are inclined to each other. Both cutting edges intersect in an imaginary corner, which, however, would not resist high mechanical loads. For this reason the corner is chamfered whereby an additional edge is formed, which also functions as a cutting edge. However, its length is normally negligible compared to the real cutting edges 271, 272. The cutting edges 271, 272 lie in one plane, wherein the described arrangement of the tools on the rotor causes this plane to run parallel to the axis A of the rotor 200. All cutting edges 272, 271 as well as the intermediate cutting edges 271*a* of the knife teeth 270 produced by the chamfering of the corner, see FIG. 7, lie in respective planes that are oriented parallel to the rotor axis A. Accordingly, also in this embodiment, all the individual comminuting tools in the form of the described reversible plates 270 presenting a cutting tooth in their installed position, describe the same flight circle having the advantages already described above with respect to the interaction with a correspondingly constructed counterknife arrangement.

In the described embodiment, all reversible plates 270 as well as the associated tool holders 250 have an identical structure.

Figure 7:
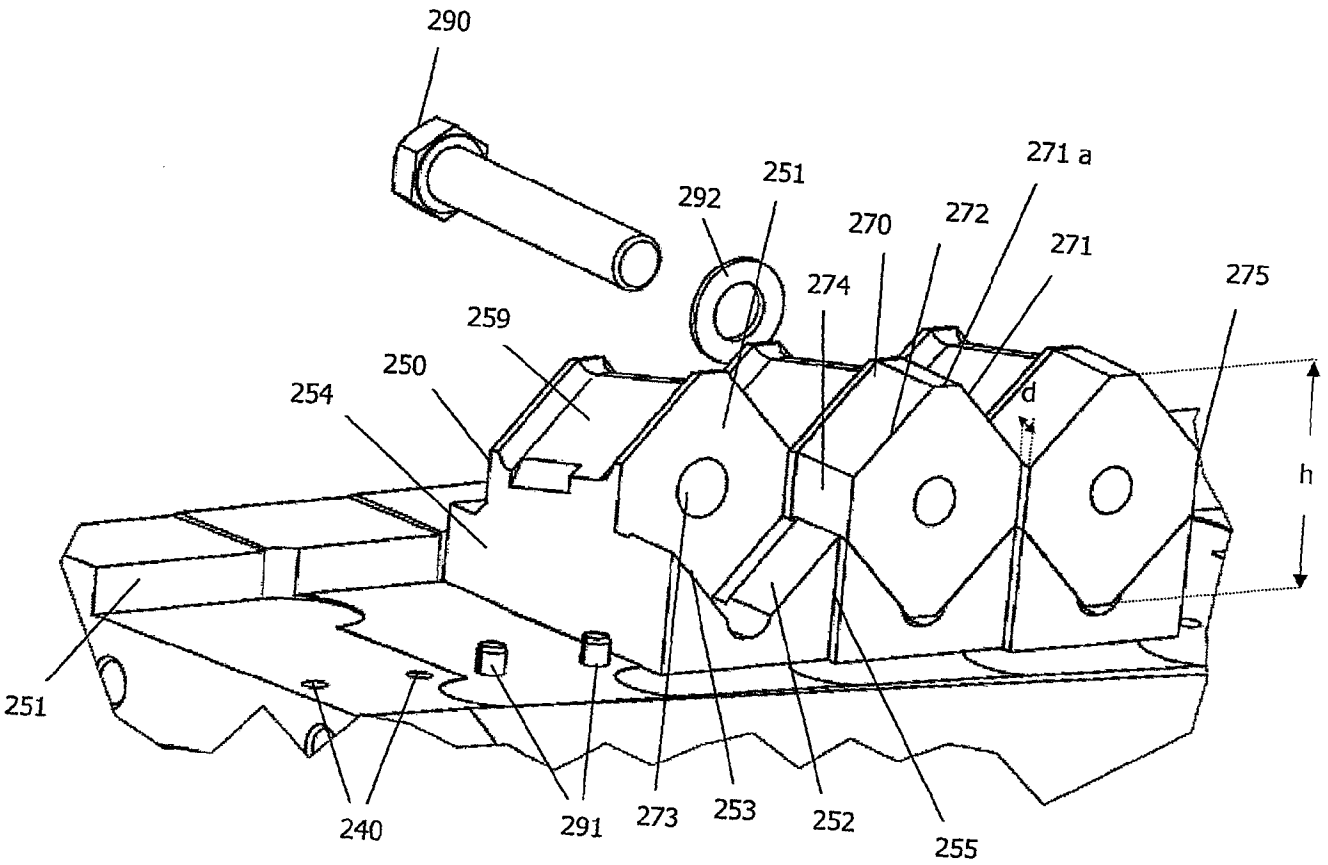
FIG. 7 a detailed view of the comminuting rotor according to FIG. 6, with the tool holders or tools partly removed.

FIG. 7 shows a detail of the knife bank 201 according to FIG. 6, wherein tool holders 250 or comminuting tools 270 have been partly omitted for the sake of clarity. A holder seat again comprises a contact surface 251 against which the tool holder 250 is supported in a tangential direction to the rotor. Bores 240 are approximately radially provided in the rotor. Fixing pins 291 can be inserted into the said bores, for fixing the holder 250 to the rotor prior to applying the above-described welding seams. To this end, each holder 250 has corresponding bores below the seat for the tool.

This tool seat in the tool holder 250 is formed by a plane contact surface 251 with a normal vector approximately tangential to the rotor and to both said surfaces 252, 253, which are inclined to each other and to which the respective tool 270 is attached laterally while said tool abuts on said contact surface 251 with its main surface that faces the tool holder 250. As can be seen in FIG. 7, for providing a knife tooth comprising said three cutting edges 271, 271*a*, and 272, the tool 270 is designed as a reversible plate with a quadrangular base body presenting cut corners, wherein the tool on both sides thereof abuts on neighboring tools via said lateral faces 274, 275. Insofar, both neighboring holders 250 and neighboring tools 270 are respectively supported one against the other in the axial direction to the rotor. FIG. 7 also shows the peripheral offset of neighboring holders or tools by the respective distance d. In the assembled condition, the edges 272, 271 are aligned with the corresponding outer surfaces of the holder following in the rotating direction. For increasing the resistance, the tool holder has recesses 259 on the exposed surfaces which are filled with a hard-facing made of an extremely durable alloy, by a welding or soldering process.

Figure 8:
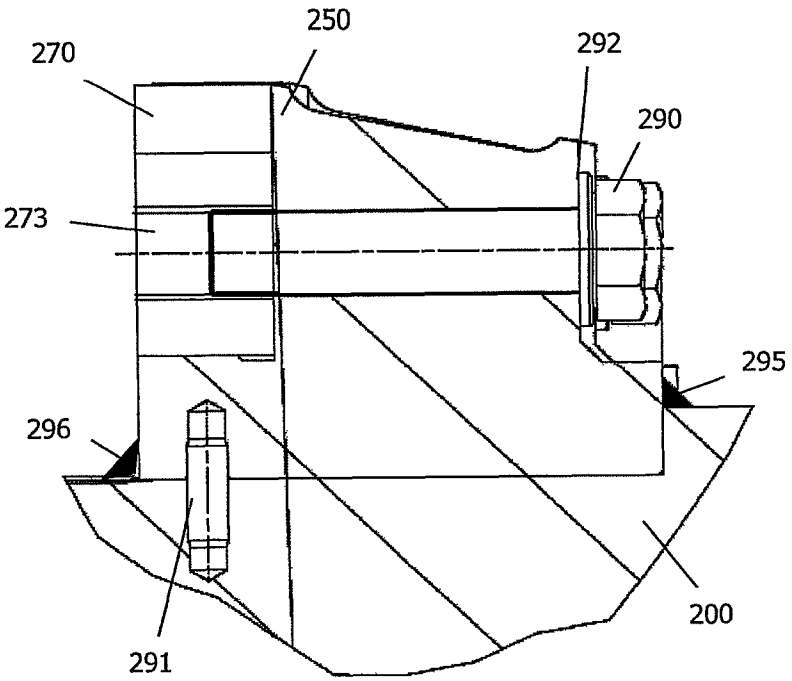
FIG. 8 a section through a tool holder supporting a comminuting tool in the form of a knife tooth.

FIG. 8 shows in a similar manner as FIG. 4 a section through a tool holder 250 with a tool 270 inserted and fixed by means of a screw 290 and a washer 292, wherein the tool holder 250 is pre-assembled to the rotor 200 by means of locating pins 291, for applying the welding seams 295, 296. The screw 290 is screwed into the threaded bore 273 of the tool 270.

Figure 9:
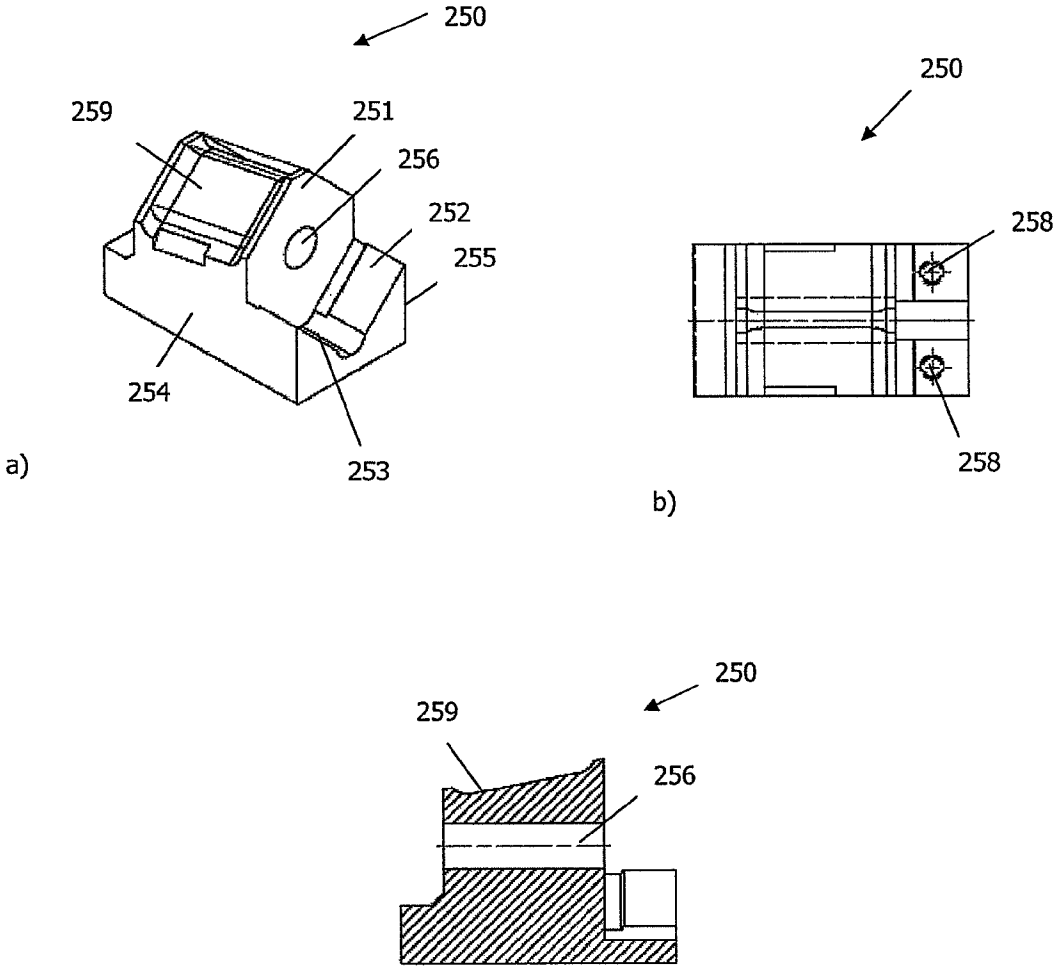
FIG. 9*a* the tool holder for supporting a tool according to FIG. 8, in a perspective view.
FIG. 9*b* the tool holder shown in FIG. 9*a*, in a top view.
FIG. 9*c* the tool holder according to FIG. 9*a*, in a sectional view.

The FIGS. 9*a* to 9*c* show the structure of the tool holder 250 for holding the reversible plate 270 in a perspective view, top view, and sectional view. This tool holder 250 also has a rectangular base area, wherein the bore 256 for receiving the stud bolt extends approximately tangentially to the rotor in the mounted state. FIG. 9*b* also shows the two bores 258, which serve for receiving the locating pin 291, see FIG. 8. The lateral faces by which the neighboring and adjoining tool holders 250 support each other in the axial direction, carry the reference numbers 254, 255.

Figure 10:
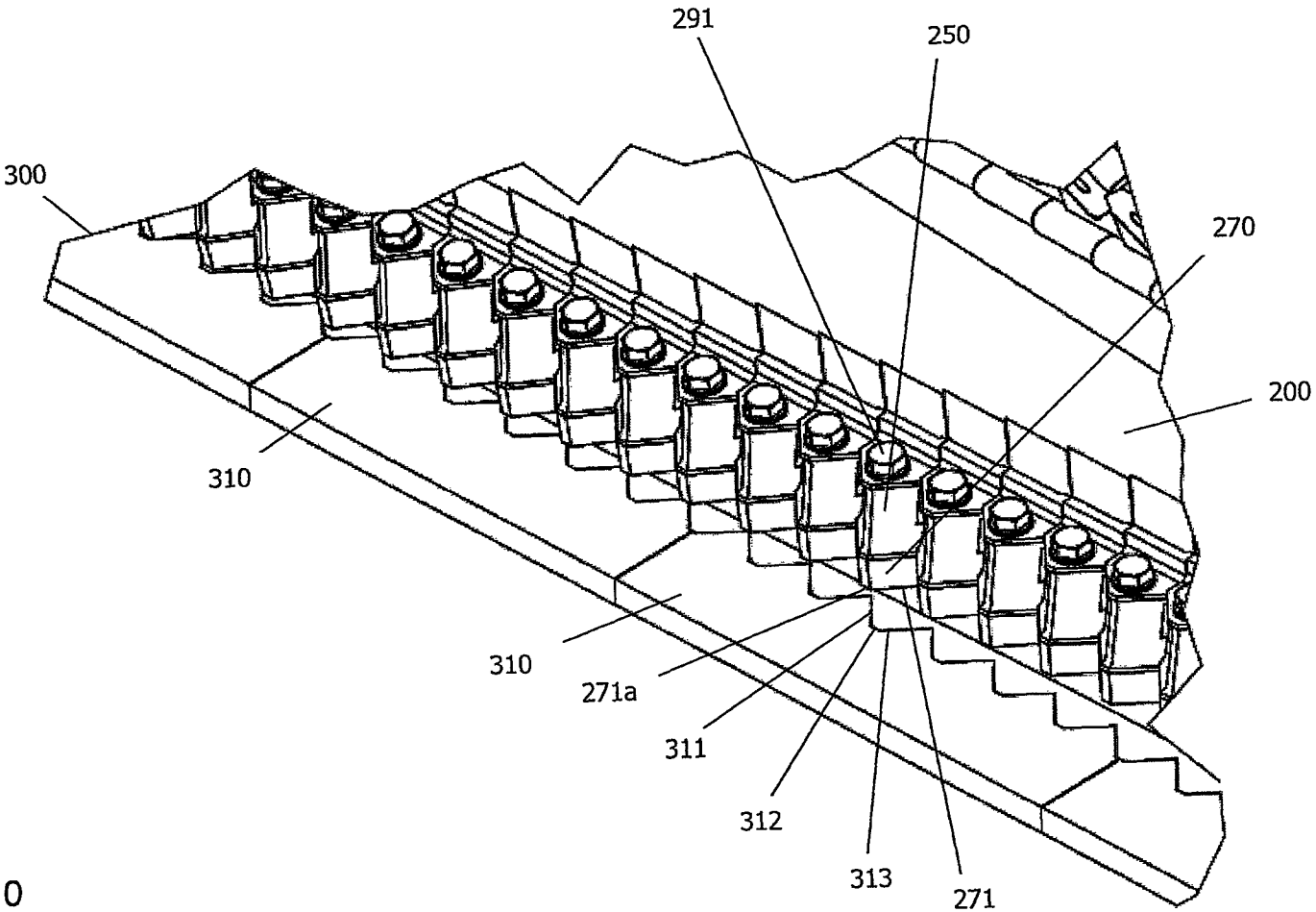
FIG. 10 a detail of FIG. 6, explaining the cooperation of the comminuting tools with an associated counterknife arrangement for the comminuting rotor of FIG. 6.

FIG. 10 is a detail showing the cooperation of the comminuting tools on a comminuting rotor according to FIG. 6 with a correspondingly adapted counterknife arrangement 300, which in the described embodiment is composed of a plurality of plate-like counterknife strips 310 strung together.

The scissors-like cooperation of the knife bank, which is formed by the plurality of comminuting tools 270 and slantingly extends with respect to the rotor, with the associated counterknife arrangement 300 in the axial direction can be clearly seen. In the Figure, the left comminuting tools mesh with their associated tooth recesses, whereas the right comminuting tools in the Figure still have an increasing distance to their respective tooth recesses.

Each of the counterknife strips 310 includes a plurality of tooth recesses that are formed by cutting edges 311, 312, 313, wherein these cutting edges lie in a plane to which the rotor axis A again runs parallel. In the described embodiment, the said plane of the cutting edges 311, 312, 313 corresponds to the plane fixed by the counterknife strips 310, wherein the rotor axis A does not lie in this plane here but only parallel to the same. This also results in a scissors-like cooperation of the cutting edges 271, 272 of the rotor tools with the associated cutting edges 311, 312 of the counterknife arrangement in such a manner that the respective tooth on the comminuting tool 270 enters into the associated tooth recess on the counterknife arrangement initially with its tip or edge 271*a*. This results in a cut drawing in the radial direction of each individual tooth structure of a reversible plate 270 which is exposed in the installed condition, in which cut the cutting edges 271, 271*a*, 272 cooperate with the associated cutting edges 313, 312, 311 of the counterknife, for disintegrating the material to be comminuted.

Figure 11:
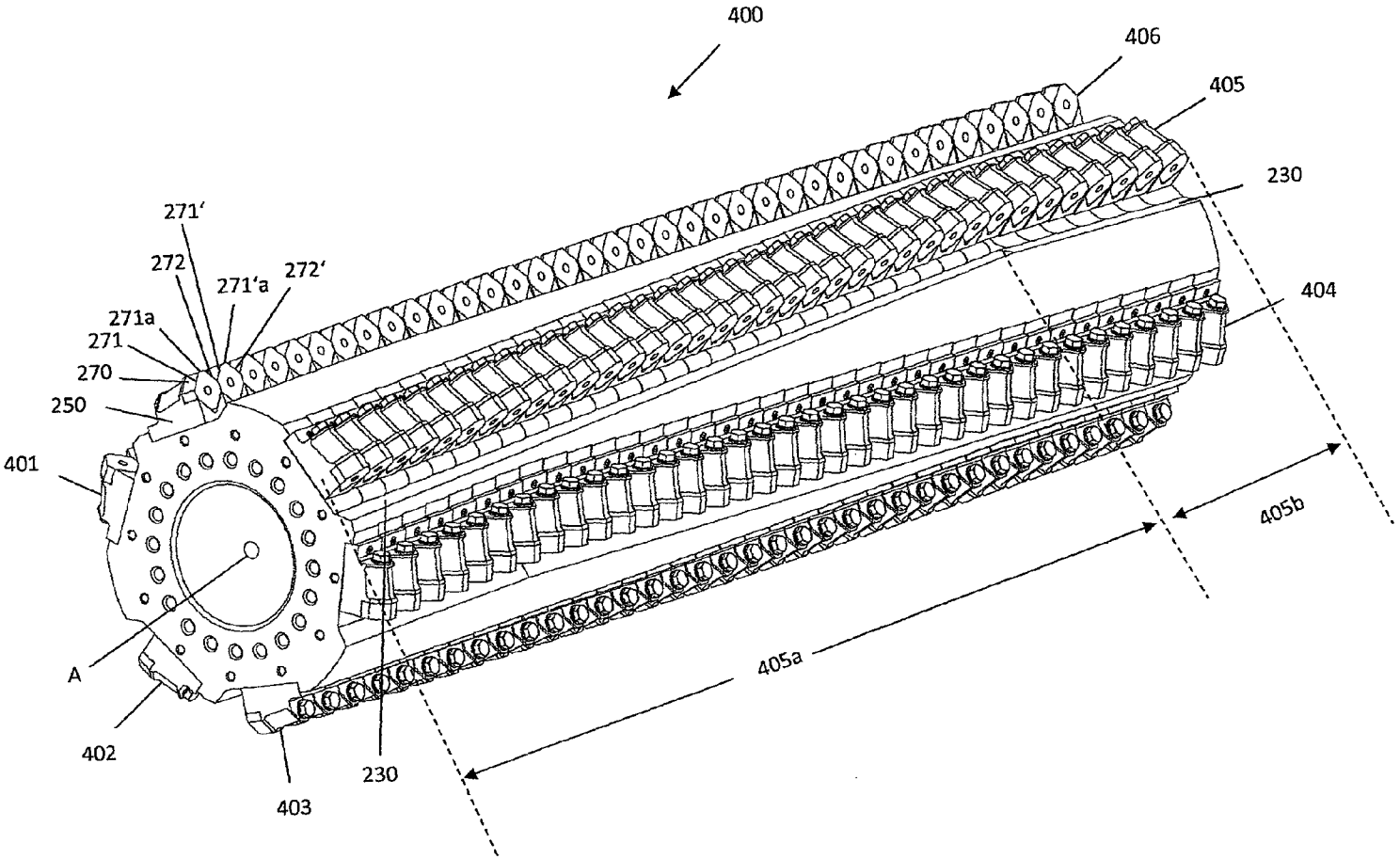
FIG. 11 a third embodiment of a comminuting rotor of a comminuting device constructed according to the invention and having a plurality of toothed cutting tools in the form of a single knifetooth.

FIG. 11 shows a third embodiment of a comminuting rotor 400 constructed according to the invention which comprises several knife banks 401 to 406, each extending in an inclined manner with respect to the axis A. The design of the comminuting tools and their fixing to and arrangement on the rotor base body is not different from the embodiment described with reference to the FIGS. 6 through 10 so that identical parts and structures are identified by identical reference signs. Accordingly, each of the knife banks 401 to 406 again comprises a plurality of adjoining and, in the present case, mutually abutting comminuting tools 270, 270' that are offset to each other in the peripheral direction of the rotor. Equivalent cutting edges 271, 271' or 272, 272' of neighboring comminuting tools have the same distance to the rotor axis, which means for example that equal points on the cutting edges 271 and 271' are equally spaced to the rotor axis. The same applies for corresponding points on the cutting edges 272 and 272'. The cutting edges 271, 272 or 271', 272' again run in one plane or they define a plane that runs parallel to the rotor axis A.

Differently from the embodiment shown in FIG. 6, the embodiment shown in FIG. 11 comprises six instead of four knife banks, which respectively extend to each other under a predetermined angle. A further difference is that at least one and normally all knife banks in the embodiment of FIG. 6 do not form a straight knife bank but instead are disposed on the rotor in a "V-shaped" manner so that an individual knife bank is composed of two linear knife bank sections, wherein these knife bank sections extend to each other under a predetermined angle on the rotor lateral area. For knife bank 405, the respective knife sections 405*a* and 405*b* are shown. It should be noted once again that despite this V-shaped arrangement of the knives or tools of a knife bank, each single tool is arranged on the rotor in the described manner, i.e. the plane defined by the cutting edges 271, 272 or 271', 272' always lies parallel to the rotor axis A. Furthermore, equivalent cutting edges 271, 272 or 271', 272' each have the same distance to the rotor axis A. Moreover, neighboring comminuting tools are conjoined and abut on each other two-dimensionally, particularly at their respectively associated lateral faces, and are offset to each other on the periphery of the rotor.

The design of an individual one of the knife banks 401 to 406 in such a manner that the same consist of different sections, which are straight sections in the present case, is obtained by directly neighboring and adjoining comminuting tools 270 or associated tool holders 250 being offset in the peripheral direction by a predetermined peripheral angle which is not constant over the entire bank but changes instead. In the embodiment shown in FIG. 11, this peripheral offset between neighboring comminuting tools is for example constant in the knife bank 405 within the section 405*a*, but is different from the offset angle in the peripheral direction within the second section 405*b* of the knife bank.

Compared to the embodiment shown in FIG. 6, a design in which an individual knife bank does not present a constant angle with respect to the rotor axis over the entire longitudinal extension thereof, but in which the angle instead varies over the said length, can provide the advantage that a larger number of knife banks can be arranged on the rotor, although the knife bank sections still present comparatively large angles with respect to the rotor axis. It will be apparent to a person skilled in the art that also the counterknife arrangement in a rotor according to FIG. 11 can be designed identically with the counterknife arrangement according to FIG. 10, for a rotor corresponding to the embodiment shown in FIG. 6. Further, it should be noted that the design of the knife banks described with reference to FIG. 11 is not limited to the use of the specific comminuting tools 270. Such a knife bank or such a comminuting rotor can be designed in a corresponding manner also using the comminuting tools shown in FIG. 3 and the associated holders 150.

Figure 12:
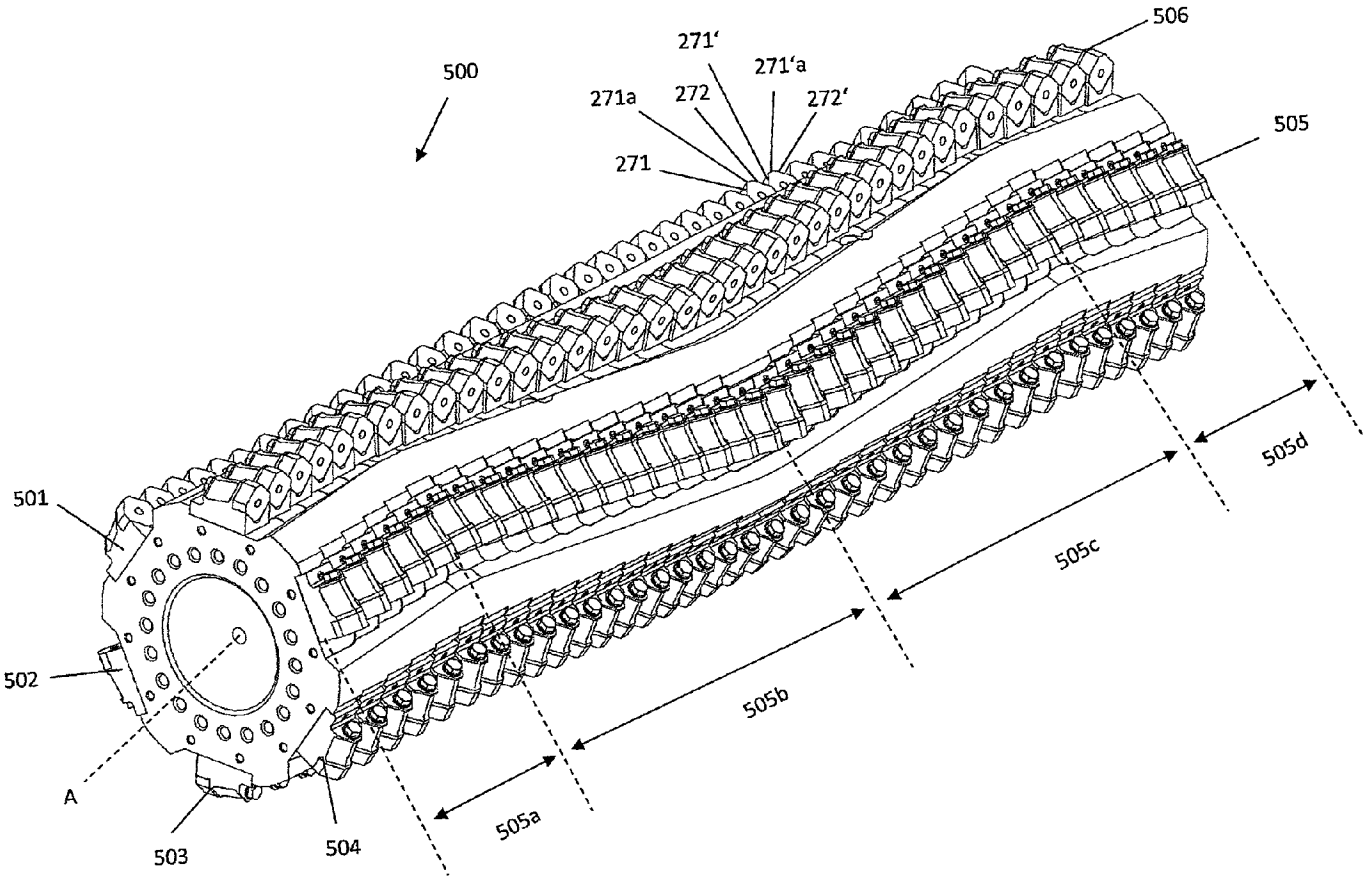
FIG. 12 a fourth embodiment of a comminuting rotor of a comminuting device constructed according to the invention.

FIG. 12 shows a further embodiment of a comminuting rotor 500 constructed according to the invention and used in a comminuting device according to the invention, wherein the rotor carries six knife banks 501 to 506 as shown in FIG. 11. The design of the individual knives and tool holders and their arrangement on the rotor is not different from the preceding embodiment. The only difference to the preceding embodiment of the comminuting rotor is that the offset angle of neighboring comminuting tools changes several times within an individual knife bank, which is illustrated in more detail in this Figure for the knife bank 505. Within the marked areas 505*a* to 505*d*, the respective offset angle in the peripheral direction of neighboring comminuting tools or their holders is constant, but is different from the same in the respectively adjacent knife bank area. As can be seen from FIG. 12, this peripheral offset of the neighboring tools can also change the direction, i.e. the peripheral direction of the offset, so that the W-shaped arrangement of an individual knife bank shown in the Figure is obtained. This design enables interleaving of the various knife banks 501 to 506 arranged on the rotor.

On the other hand, according to the invention, a knife bank can also include non-linear sections, i.e. curved sections, which are obtained by the peripheral offset of neighboring tools not being constant but changing over the longitudinal extension of the knife bank, for instance in such a manner that a wave-like arrangement of a knife bank on the rotor is obtained.

In the embodiment which is shown in FIG. 12 and in the modifications thereof that have been discussed, neighboring comminuting tools of a knife bank 501 to 506 also abut on each other at associated lateral faces and are offset to each other on the periphery of the rotor, wherein equivalent cutting edges 271, 271' or 272, 272' of neighboring comminuting tools have the same distance to the rotor axis and wherein the respective cutting edges 271, 272 or 271', 272' of a tool 270 or 270' lie in a plane which runs parallel to the rotor axis so that there is again achieved an ideal cooperation with the counterknife arrangement described with reference to FIG. 10.

Depending on the intended use and on the embodiment of the comminuting device of the invention, more than four, in particular six or seven knife banks can be disposed on the rotor. By increasing the number of the knife banks that can be disposed on the periphery of the rotor in an interleaving manner as described above, the comminution efficiency of the comminuting device of the invention can be further increased. The comminuting device of the invention can be adjusted for the respective comminuting job in a flexible manner. A practicable effective diameter of the rotor having the comminuting tools arranged thereon can particularly amount to between 40 cm and 200 cm. The use of a plurality of comminuting tools, which are detachably mounted to the rotor in the manner as described, enables the exchange of blades or tools within smallest sections of a knife bank, and in this connection it turned out to be useful if more than thirty of such comminuting tools per 1 m length of the rotor, in particular more than fifty comminuting tools per one meter length of the rotor, and most preferably more than eighty comminuting tools per one meter length of the rotor are provided.

LIST OF REFERENCE SIGNS

1 comminuting device
20 machine housing
21 legs
22 torque support
23 holder
24 opening
25 sheet metal funnel
26 comminuting space
30 supporting sheet
35 limit stop
40 three-phase AC motor
50 conveying device
51 conveyor motor
60 counterknife traverse
100 comminuting rotor
101-104 knifebank
110 holder seat
111 contact surface
130 chip pocket
150 tool holder
151, 152 contact surface
155 inclined surface
156, 158 bore
157*a, b* lateral face
170 smooth-knife reversible plate
171 cutting edge
172 threaded bore
173, 174 lateral face
190 fixing screw
191 locating pin
195, 196 welding seam
200 comminuting rotor
201-204 knife bank

210 holder seat
211 contact surface
230 chip pocket
250 tool holder
251, 242, 253 contact surface
254, 255 lateral face
259 recess for armored protection
270 comminuting tool, knife-tooth reversible plate
271, 271*a* cutting edge
271', 271*a*' cutting edge
272, 272' cutting edge
273 threaded bore
274, 275 lateral face
290 fixing screw
291 locating pin
292 washer
295, 296 welding seam
300 counterknife arrangement
310 counterknife strip
311, 312, 313 cutting edge
400 comminuting rotor
401-406 knife bank
405*a*, 405*b* knife bank section
500 comminuting rotor
501-506 knife bank
505*a*-505*d* knife bank section
A rotor axis
d offset
R rotating direction of rotor

The invention claimed is:

1. A comminuting device for material to be comminuted, the device comprising a driving device that drives at least one comminuting rotor having a rotor axis, the comminuting rotor presenting on the periphery thereof a plurality of comminuting tools that are fixed to said comminuting rotor, for forming a knife bank extending slantingly with respect to the axial direction of said comminuting rotor, the comminuting device further comprising at least one counterknife arrangement having a shape that corresponds to the rotation surface of the comminuting rotor so as to cooperate with said comminuting tools for disintegrating the material to be processed, wherein within the knife bank neighboring comminuting tools are arranged adjacent to each other and abutting on each other at respectively associated lateral faces, and a cutting edge of each tool is offset with respect to a cutting edge of each neighboring tool on the periphery of the rotor, wherein equivalent cutting edges of neighboring comminuting tools have the same distance to the rotor axis and each lie in a plane that runs parallel to the rotor axis.

2. The comminuting device according to claim 1 further comprising a comminuting tool detachably mounted to the rotor via an associated tool holder, wherein the respective tool holder is arranged in a holder seat incorporated into the comminuting rotor.

3. The comminuting device according to claim 2, wherein the holder seat provides an approximately tangentially directed contact surface for the associated tool holder, which is supported against the contact surface in the tangential direction.

4. The comminuting device according to claim 2 further comprising radially extending pins disposed inside the rotor, wherein the pins extend out of a holder seat and into the associated tool holder.

5. The comminuting device according to claim 2, wherein a comminuting tool is fixed via a fixing bolt extending through the respective tool holder.

6. The comminuting device according to claim 2, wherein the tool holder comprises an angled base area, wherein a front face of the tool holder facing the rotating direction of the rotor defines a seat for receiving the associated comminuting tool.

7. The comminuting device according to claim 6, wherein the angled base area is a quadrangular base area.

8. The comminuting device according to claim 1 further comprising a plurality of knife banks formed by a plurality of comminuting tools, two of said knife banks being respectively arranged peripherally on the comminuting rotor in a manner spaced to each other and in an opposite direction to each other, for the mutual compensation of the application of an axial motion component to the material to be comminuted.

9. The comminuting device according to claim 1, wherein tool holders of neighboring comminuting tools of a knife bank are arranged so as to abut on each other at associated lateral surfaces.

10. The comminuting device according to claim 1, wherein the comminuting rotor defines a continuous recess that runs parallel to the knife bank for forming a chip pocket upstream of the knife bank in the rotating direction of the rotor.

11. The comminuting device according to claim 10, wherein the peripheral extension of said recess upstream of the comminuting tools in the installed position approximately corresponds to the height of the comminuting tools in the radial direction.

12. The comminuting device according to claim 1, wherein the comminuting tool is constructed as a reversible plate and in the installed position provides a single knife tooth, wherein said reversible plate is arranged in a prismatic seat of the associated tool holder.

13. The comminuting device according to claim 12, wherein lateral faces of said reversible plate are aligned with lateral faces of a tool holder.

14. The comminuting device according to claim 1, wherein the at least one counterknife arrangement is equipped with strips having tooth recesses so as to cooperate with said comminuting tools for disintegrating the material to be processed.

* * * * *